US007178877B2

(12) United States Patent
Watson

(10) Patent No.: US 7,178,877 B2
(45) Date of Patent: Feb. 20, 2007

(54) DIAPER CHANGING RESTRAINT SYSTEM

(76) Inventor: Carol A. Watson, 63 Trent Rd., Turnersville, NJ (US) 08012

( * ) Notice: Subject to any disclaimer, the term of this patent is extended or adjusted under 35 U.S.C. 154(b) by 0 days.

(21) Appl. No.: 11/226,682

(22) Filed: Sep. 14, 2005

(65) Prior Publication Data

US 2006/0108855 A1 May 25, 2006

Related U.S. Application Data

(60) Provisional application No. 60/610,080, filed on Sep. 15, 2004.

(51) Int. Cl.
*A47D 15/00* (2006.01)
*A47C 7/02* (2006.01)

(52) U.S. Cl. ..... 297/484; 5/603

(58) Field of Classification Search ..... 297/486, 297/464, 468, 469, 484, 483, 250.1; 5/417, 5/655, 621, 603, 628; 128/869, 878, 875–876, 128/870, 846
See application file for complete search history.

(56) References Cited

U.S. PATENT DOCUMENTS 4,234,228 A * 11/1980 Flamm ..... 297/464
5,076,264 A * 12/1991 Lonardo et al. ..... 602/19
5,161,270 A * 11/1992 Najmabadi ..... 5/424
5,165,130 A * 11/1992 Wendling ..... 5/655
5,367,730 A * 11/1994 Sher ..... 5/655
5,468,046 A * 11/1995 Weber et al. ..... 297/238
5,915,789 A * 6/1999 Ponce De Leon, III ..... 297/484
6,023,802 A * 2/2000 King ..... 5/655
D508,359 S * 8/2005 Thomas ..... D6/610

* cited by examiner

*Primary Examiner*—Milton Nelson, Jr.
(74) *Attorney, Agent, or Firm*—Maryellen Feehery Hank; Reed Smith LLP

(57) ABSTRACT

A diaper changing restraint system is provided which restricts movement of an infant during diapering activities. The restraint system comprises a portable base, at least a portion of which is substantially rigid. A pad is secured to the base. The pad has a top surface which supports the person intended to be restrained. A first cushion and a second cushion, each extending from the top surface, are secured to the pad. The first cushion is spaced a predetermined distance from the second cushion so as to accommodate the torso of the person lying between the first cushion and the second cushion during the restraining. The first cushion and the second cushion are capable of supporting sides of the torso of the person, restricting lateral movement of the person.

7 Claims, 6 Drawing Sheets

DIAPER CHANGING RESTRAINT SYSTEM

RELATED APPLICATIONS

Priority is claimed based on U.S. provisional application 60/610,080 filed on Sep. 15, 2004.

FIELD OF THE INVENTION

The present invention relates generally to the field of bodily restraint systems and more specifically to restraint systems which are used for diapering activities.

BACKGROUND OF THE INVENTION

Often times, changing an infant's diaper can prove to be a difficult task. Many a care-giver has struggled to maintain a writhing infant in a suitable position for a diaper change. As babies learn to move about, they are less inclined to remain still when placed upon their backs. Commonly during a diapering activity, a growing infant will roll over, sit up, and/or push himself in a head-wise direction by planting his heels and thrusting his legs, thereby making the task of diaper changing a multiple-hand challenge. For instance, one hand is needed to hold the infant in a secure position while one or more hands are needed to remove and replace the diaper. Because most individuals do not have the dexterity to perform such a task, the infant is often not safely secured on a changing surface. As a result, the care-giver changing the diaper must maintain constant supervision and attention to the infant. In addition to causing considerable inconvenience to the care-giver, such movements create significant hazards. Sadly, many infants have suffered serious injuries after falling from elevated changed surfaces.

Thus, it is desirable to provide a diaper changing restraint system which is able to overcome the above disadvantages.

SUMMARY OF THE INVENTION

The present invention is directed to a restraint system, comprising a portable base, wherein at least a portion of the base is substantially rigid. The restraint system also comprises a pad secured to the base, wherein the pad has a top surface which supports the person intended to be restrained. The pad comprises a first cushion and a second cushion. The first and second cushions extend from the top surface, the first cushion being spaced a predetermined distance from the second cushion so as to accommodate the torso of the person lying between the first cushion and the second cushion during the restraining. The first cushion and the second cushion are capable of supporting sides of the torso of the person, thereby restricting lateral movement. The pad may also comprise a torso restraint extending from the first cushion to the second cushion. The torso restraint is positioned adjacent to the chest of the person to thereby restrict movement of the torso.

In addition to, or instead of, the torso restraint, the pad may further comprise at least one shoulder restraint extending therefrom. The shoulder restraint restricts movement of a shoulder or upper body of the person, thus preventing the person from sitting up, rolling, or pushing the pad up or down. Alternately, the base may comprise at least one shoulder restraint extending therefrom.

DETAILED DESCRIPTION OF THE INVENTION

Figure 1:
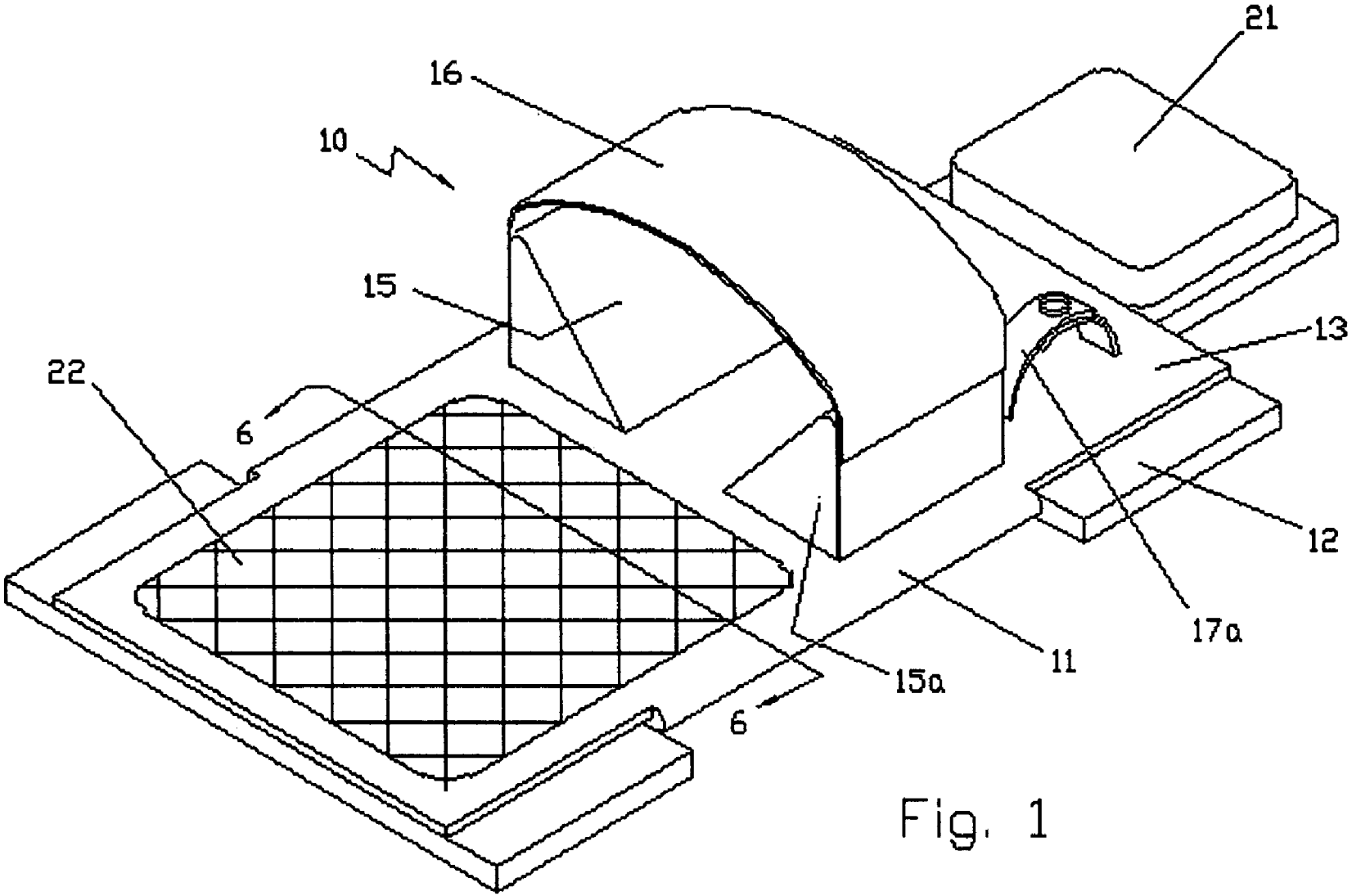
FIG. 1 is an isometric view of the diaper changing restraint system of the present invention.
Figure 2:
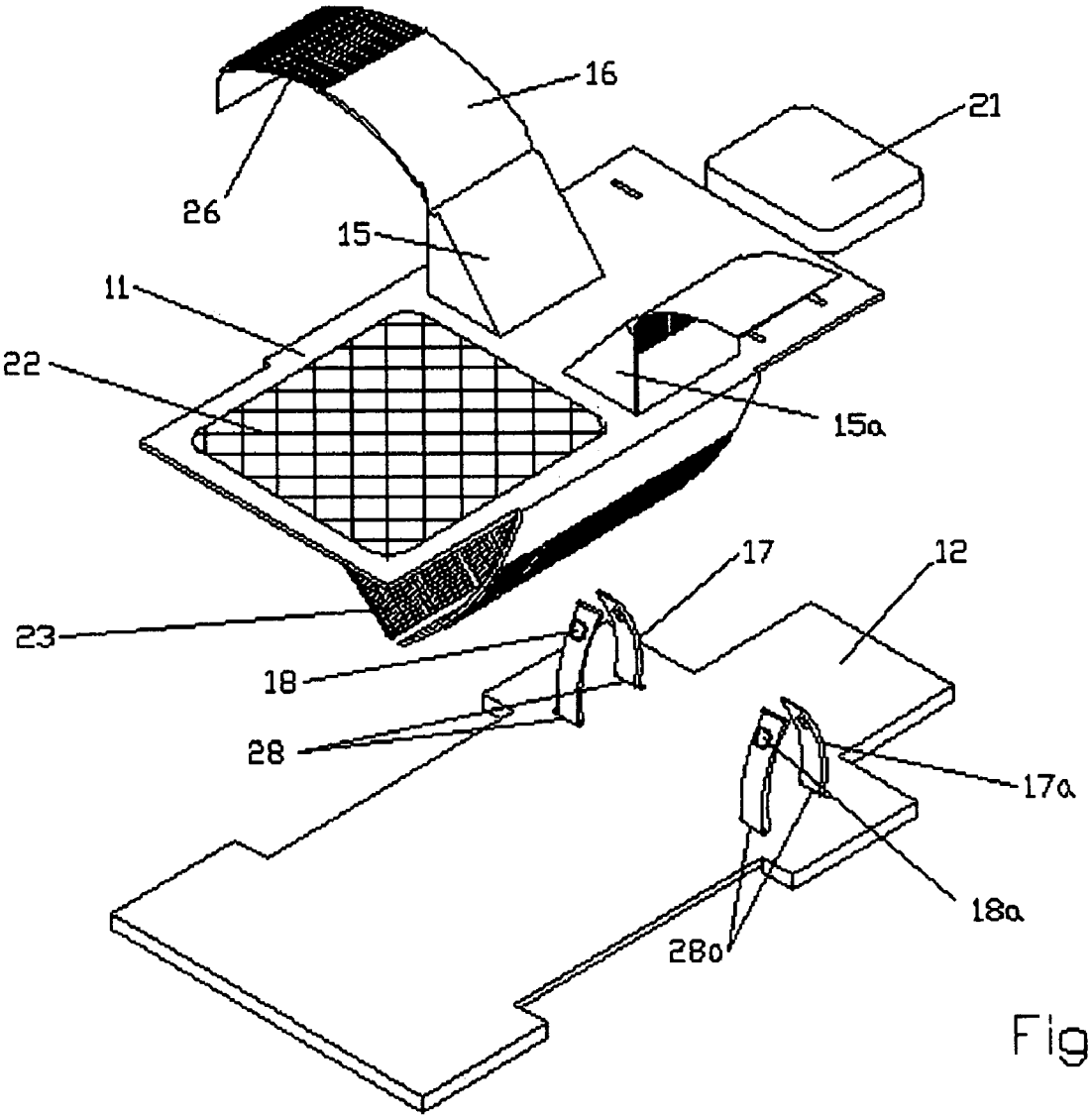
FIG. 2 is an exploded isometric view of the diaper changing restraint system of the present invention.
Figure 3:
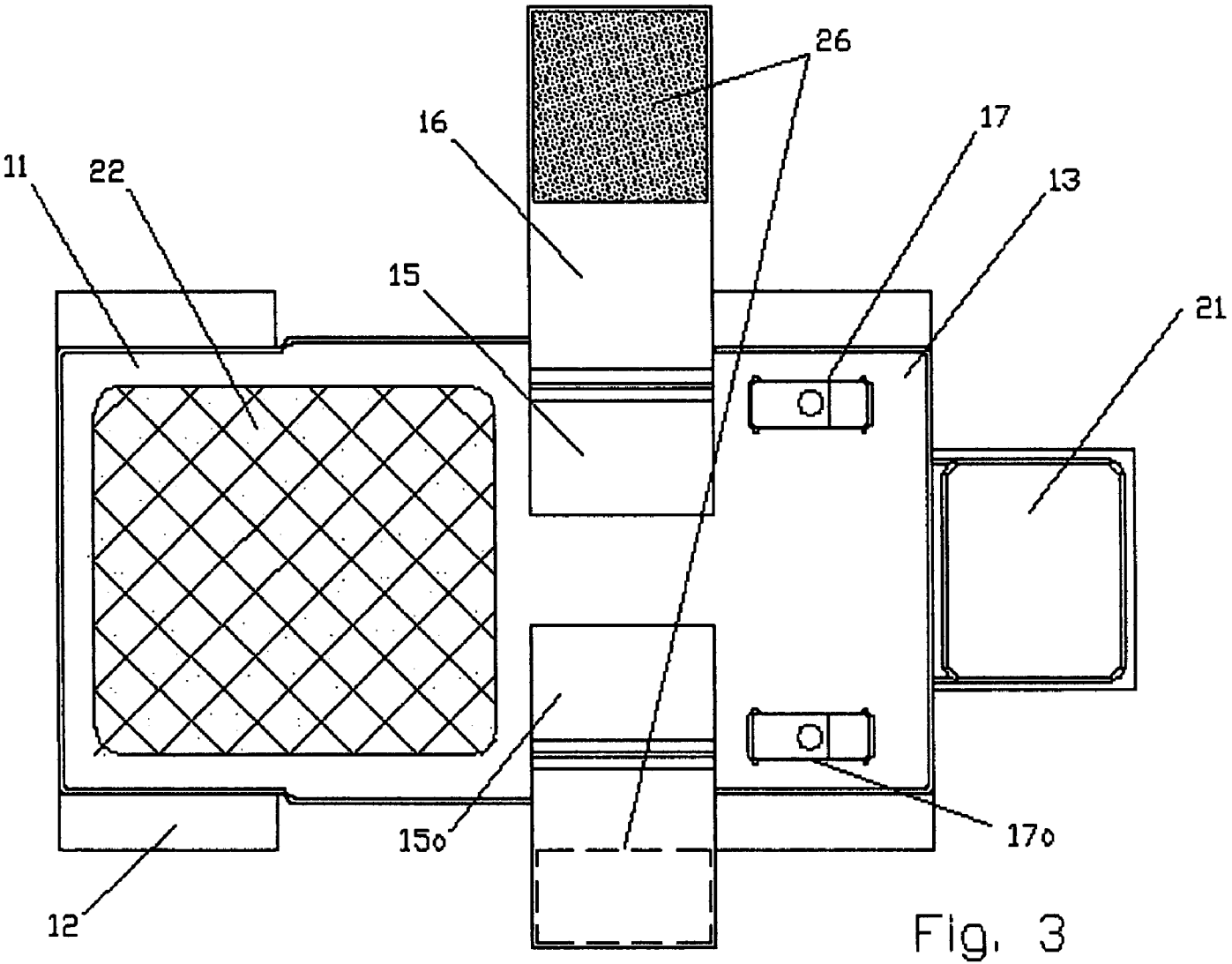
FIG. 3 is a top view of the diaper changing system of the present invention.

It is to be understood that the figures and descriptions of the present invention may have been simplified to illustrate elements that are relevant for a clear understanding of the present invention, while eliminating, for purposes of clarity, other elements found in a typical diaper changing restraint system. Those of ordinary skill in the art will recognize that other elements may be desirable and/or required in order to implement the present invention. However, because such elements are well known in the art, and because they do not facilitate a better understanding of the present invention, a discussion of such elements is not provided herein. It is also to be understood that the drawings included herewith only provide diagrammatic representations of the presently preferred structures of the present invention and that structures falling within the scope of the present invention may include structures different than those shown in the drawings. Reference will now be made to the drawings wherein like structures are provided with like reference designations.

Referring to FIG. 1, there is shown an isometric view of a diaper changing restraint system 10, in accordance with a preferred embodiment of the present invention. Restraint system 10 is an assembly of components including a pad 11 which is removably secured to portable base 12. Pad 11 includes at least two cushions 15 and 15*a* extending therefrom. Pad 11 may comprise any suitable material to support an infant lying thereon, such as, for example, cotton, terry cloth, quilted fabric. Pad 11 may include a pillow portion 21. At least the exterior of pad 11 or a portion thereof, without limitation, comprises waterproof material 22. The waterproof material may alternatively be under an outer material such as terry cloth. The interior of pad 11 may preferably comprise a cushioned material such as foam, batting, plush or equivalent material. Pad 11 may be foldable, collapsible, disposable, be attached to or be part of a diaper bag, and be of any suitable size for use by an infant or handicapped people, adults, or the elderly (e.g. in nursing facilities). Pad 11 may itself be inclined (i.e. using varying cushioning thicknesses) or may adopt the incline of base 12 as discussed below, or the incline may be effected by a combination of an inclined pad 11 and an inclined base 12.

At least a portion of base 12 is substantially rigid and may comprise any suitable material such as plastic, wood Plexiglas®, carbon fiber, etc. Base 12 is preferably a rigid plastic mold made, for example, by thermal molding. Base 12 may be foldable (preferably with at least one hinged portion), collapsible, and be of any suitable size to be used in conjunction with the correspondingly sized pad 11 for use by an infant or handicapped people, adults, or the elderly. To prevent the infant plus pad/base from moving/rolling over (i.e. where the infant can reach beyond base 12 to gain a foothold to enable possible overturning), base 12 is preferably sized larger in height than the height of the infant, and/or sized larger in width than the distance of the span of the infant's hands when the infant's hands are fully extended away from the infant's body. Pad 11 and base 12 may be sized for travel use (in a vehicle) or sized for placement on any table (i.e. a diapering table/station), or simply placed on the ground. Base 12 may be inclined to adjust for varying degrees of positioning such as on a simple incline for various uses like feeding, or in a V-shaped configuration for placement on a car seat.

Figure 5:
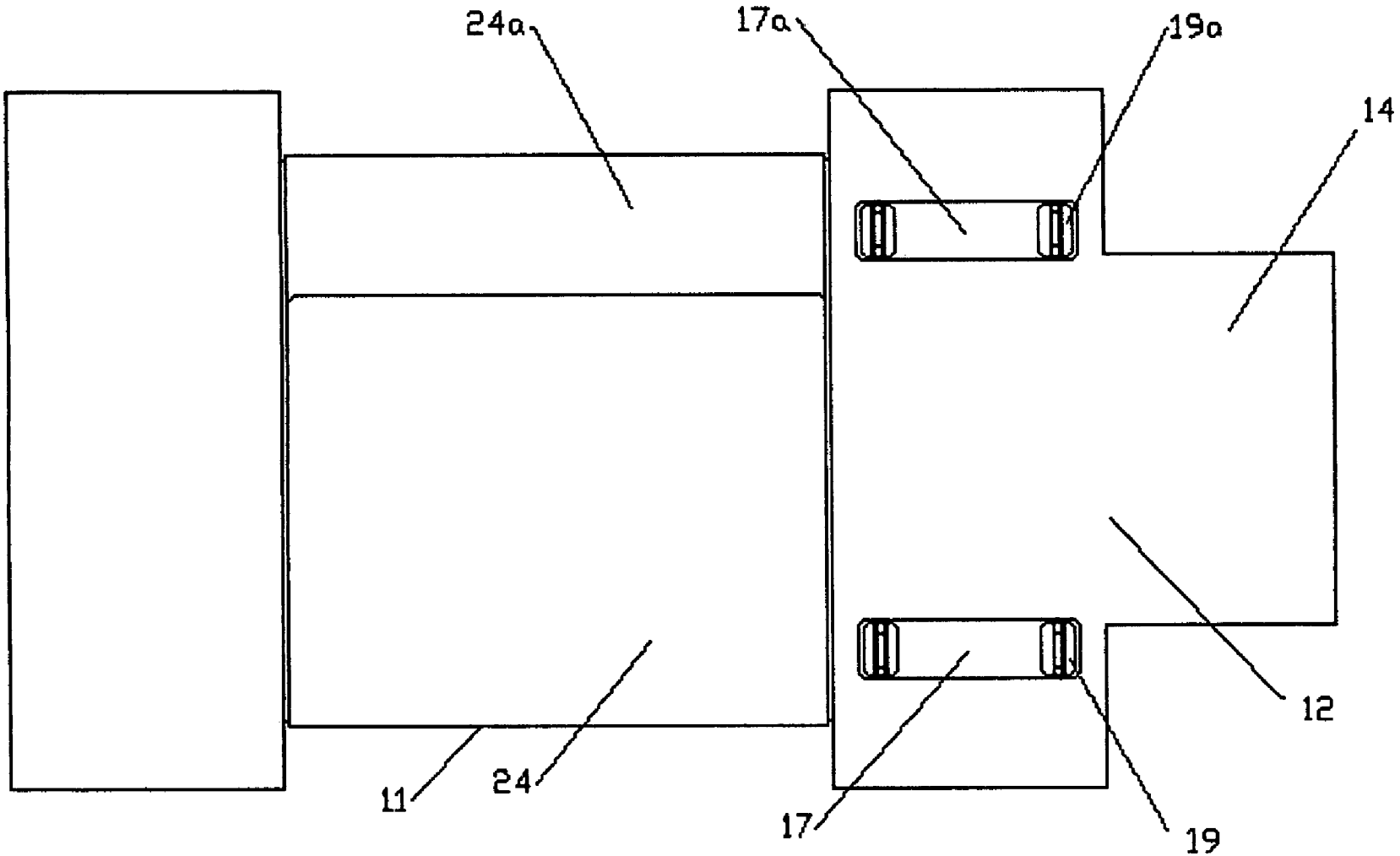
FIG. 5 is a bottom view of the base of the diaper changing restraint system of the present invention.
Figure 6:
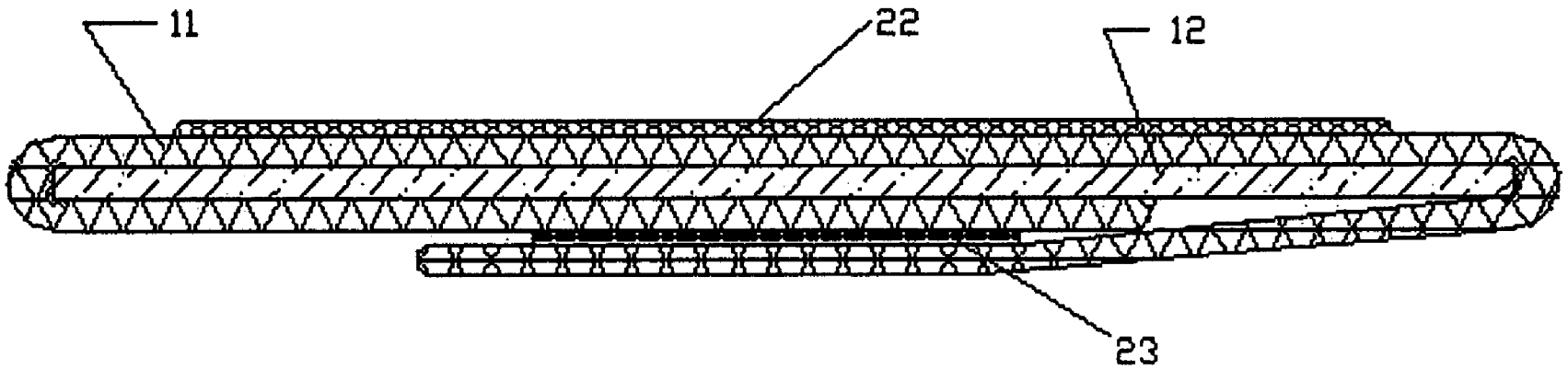
FIG. 6 is a cross-sectional view of the present invention taken from FIG. 1.

Pad 11 may be secured to base 12 using various techniques. FIG. 5 shows side portions 24 and 24*a* of pad 11 wrapped around bottom 14 of the base 12. At least one removable fastener 23, for example, a snap, a clasp, buckle, button, hook, hook/latch type (e.g. Velcro®), or combination thereof, may be used to secure side portions 24 and 24*a* to each other along bottom 14 of base 12 such that pad 11 envelopes at least a portion of the base. Alternatively, pad 11 may be permanently affixed to base 12 using, for example, a glue such as an epoxy or adhesive.

Pad 11 includes two cushions 15 and 15*a* extending therefrom. Cushions 15 and 15*a* are preferably secured to the main portion of the pad by way of sewed seams 25 and 25*a* or, alternatively, by other types of securement configurations like a hook/latch (e.g. Velcro®) configuration. If a Velcro® or like attachment means is used, either or both of the cushions 15 and 15*a* may be removable and replaced from the main portion of pad 11 to effect a differing distance between the cushions, so as to accommodate an infant's growth. Cushions 15 and 15*a* extend from the top surface of pad 11, first cushion 15 being spaced a predetermined distance from second cushion 15*a* so as to accommodate a torso of the person lying between the cushions during restraining. The two cushions are capable of supporting the sides of the torso of the person, thereby restricting lateral movement of the person.

In another embodiment of the invention, torso restraint 16 may optionally be employed for use with cushions 15 and 15*a*. Torso restraint 16 is preferably in the form of a fabric or similar band of material. Torso restraint 16 extends from first cushion 15 to second cushion 15*a* and is positioned adjacent to the chest of the person, to thereby restrict movement of the torso. Torso restraint 16 may be permanently or temporarily secured, preferably using a hook/latch (e.g. Velcro®) configuration 26, to either or both of cushions 15 and 15*a*. Other securement configurations of the torso restraint 16 to cushions 15 and 15*a* are contemplated.

Another feature of the present invention includes at least one shoulder restraint 17 to thereby restrict movement of the shoulder of the person. Exemplary shoulder restraints 17 and 17*a* preferably include shoulder straps which may either extend from pad 11, and/or from base 12. Restraints 17 and 17*a* extend from pad 11 and/or base 12 from above and below the intended position of the infant's shoulder. The separate straps for restraints 17 and 17*a* are connected to each other via fasteners 18 and 18*a*, respectively, such as by a snap, a clasp, buckle, button, hook, hook/latch type (e.g. Velcro®), or combination thereof. Restraints 17 and 17*a* may be adjustable via typical tensioning techniques like multiple fastening positions (e.g. using a configuration of an array of buttons or snaps).

Figure 4:
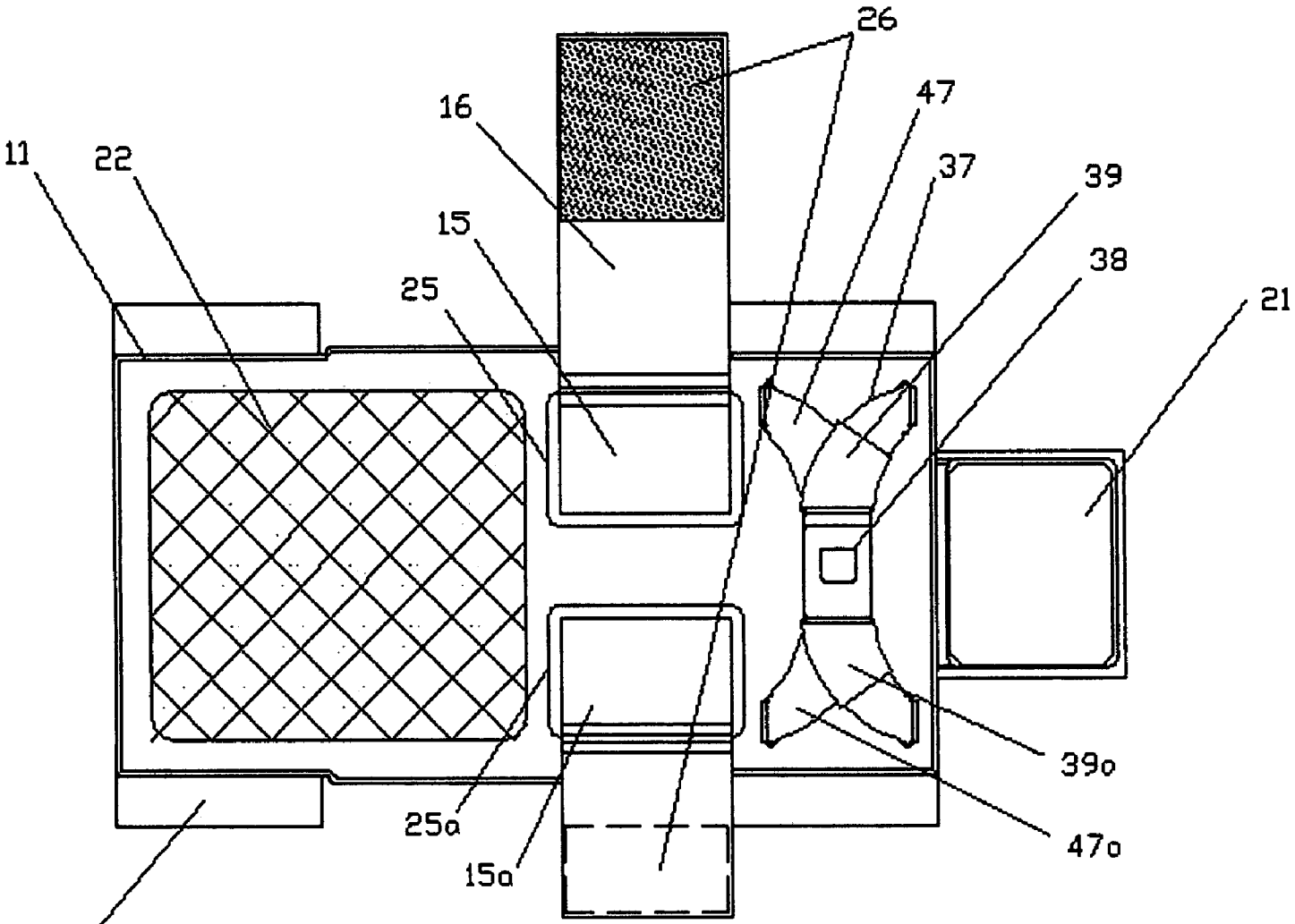
FIG. 4 is a top view of an alternate embodiment of the diaper changing restraint system of the present invention.

If extending from base 12, restraints 17 and 17*a* may preferably extend through holes 28 and 28*a* in pad 11. Buckles 19 and 19*a* or other fastener provided at the ends of restraints 17 and 17*a* secure the restraints to bottom 14 of the base 12, via holes 28 and 28*a*. Other shoulder restraint configurations, for example the type in FIG. 4, may be employed in place of the restraints 17 and 17*a*. Restraint 37 includes shoulder straps 47 and 47*a* which are removably secured together via buckle 38. The straps of 17, 17*a*, 47 and 47*a* include pads 39 and 39*a* for comfort.

In any of the embodiments, pad 11 and/or base 12 may include a concave top surface or raised rib/lip 13 in the location where the infant is to be restrained (or surrounding the infant) so as to further prevent the infant from rolling over.

An infant, when lying on restraint system 10 as discussed above, is prevented from rolling, sitting, or sliding, thereby safely facilitating efficient changing of a diaper. The combination of the infant being secured to pad 11, which in turn is secured to the substantially rigid base 12, will prevent the infant from flipping the entire base/pad off of the surface on which restraint system 10 is positioned thereupon. It will also prevent the infant from twisting, turning, or rolling off pad 11 and onto the ground. Moreover, restraint system 10 eliminates the possibility that an infant will crawl away or even be able to roll onto its stomach, thus greatly helping care-givers change/dress and care for their infant with great ease and safety. The addition of either torso restraint 16 and/or restraints 17, 17*a*, 47 and 47*a* aid in additional restraint efficacy and may selectively be chosen to be utilized dependent on how "difficult" or mobile the infant is.

Although an infant is described in the embodiments above, a person of any age may also be restrained by the devices described in the embodiments above. Also, activities other than diapering may be performed on the infant during use of restraint system 10, e.g. administering medication, applying lotions, dressing, a hygiene session, etc.

Those of ordinary skill in the art will recognize that various modifications and variations may be made to the embodiments described above without departing from the spirit and scope of the present invention. For example, the shoulder restraint may be of other configurations such as a vest type restraint. Furthermore, any or all parts of restraint system may be washable and/or water resistant. It is therefore to be understood that the present invention is not limited to the particular embodiments disclosed above, but it is intended to cover such modifications and variations as defined by the following claims.

What is claimed:

1. A restraint system for changing a diaper of and restraining movement of a horizontally positioned person when lying on a pad, said system comprising:

a portable base, of a given length consisting of a single, substantially rigid, substantially flat member located solely within a single transverse plane;

a pad secured to the base, the entire pad located substantially within a single transverse plane and overlaying at least a portion of the length of the base, said pad having a tap surface for supporting the horizontally positioned person when lying on the pad;

first cushion and second cushion, each said cushion extending substantially upward from the top surface, the first cushion spaced a predetermined distance from the second cushion whereby the first cushion and the second cushion support sides of a torso of the horizontally positioned person when lying on the pad, thereby restraining lateral movement of the horizontally positioned person when lying on the pad; and wherein the pad further comprises a torso restraint for restricting the movement of the torso, the torso restraint attached to the first cushion, extending from the first cushion for attachment to the second cushion, and positioned adjacent to the torso of the horizontally positioned person when lying on the pad.

2. The restraint system of claim 1 wherein the pad further comprises at least one shoulder restraint extending from the pad to restrict movement of the shoulder of the horizontally positioned person when lying on the pad.

3. The restraint system as in claim 2 wherein the shoulder restraint extends from the base and through the pad.

4. The restraint system of claim 1 wherein the base comprises at least one shoulder restraint extending from the base to restrict movement of the shoulder of the horizontally positioned person when lying on the pad.

5. The restraint system of claim 1 wherein the pad comprises a waterproof surface.

6. The restraint system as in claim 1 further comprising an attachment to removeably secure the base to the pad.

7. The restraint system as in claim 6 wherein the attachment is located on the bottom of the pad.

* * * * *